United States Patent [19]

Bhangu et al.

[11] 4,315,406

[45] Feb. 16, 1982

[54] PERFORATE LAMINATED MATERIAL AND COMBUSTION CHAMBERS MADE THEREFROM

[75] Inventors: Jagnandan K. Bhangu, Ockbrook; Peter Fry, Allestree; David Hustler, Nelson, all of England

[73] Assignee: Rolls-Royce Limited, London, England

[21] Appl. No.: 137,776

[22] Filed: Apr. 7, 1980

[30] Foreign Application Priority Data

May 1, 1979 [GB] United Kingdom ..... 15152/79

[51] Int. Cl.[3] ..... F23R 3/44

[52] U.S. Cl. ..... 60/754; 428/137; 428/596

[58] Field of Search ..... 428/573, 137, 596, 597; 60/754; 431/352, 353

[56] References Cited

U.S. PATENT DOCUMENTS

| | | | |
|---|---|---|---|
| 2,422,213 | 6/1947 | Smith | 60/758 |
| 2,498,728 | 2/1950 | Way | 60/39.36 |
| 2,654,219 | 10/1953 | Zaba | 60/752 |
| 2,657,531 | 11/1953 | Pierce | 60/755 |
| 2,919,549 | 1/1960 | Haworth et al. | 60/39.65 |
| 3,064,425 | 11/1962 | Hayes | 60/39.65 |
| 3,349,558 | 10/1967 | Smith | 60/39.65 |
| 3,554,663 | 1/1971 | Helms | 416/90 R |
| 3,560,107 | 2/1971 | Helms | 416/90 R |
| 3,572,031 | 3/1971 | Szetela | 60/39.65 |
| 3,584,972 | 6/1971 | Bratkovich | 416/229 |
| 3,593,525 | 6/1971 | Holmes | 60/254 |
| 3,606,572 | 9/1971 | Schwedland | 416/90 R |
| 3,606,573 | 9/1971 | Emmerson et al. | 416/90 R |
| 3,616,125 | 10/1971 | Bowling | 416/90 R |
| 3,619,082 | 11/1971 | Meginnis | 416/90 R |
| 3,620,643 | 11/1971 | Jones | 416/90 R |
| 3,806,276 | 4/1974 | Aspinwall | 416/97 |
| 3,864,199 | 2/1975 | Meginnis | 416/90 R |
| 3,900,628 | 8/1975 | Stewart | 428/134 |
| 3,910,039 | 10/1975 | Fortini | 60/265 |
| 3,963,368 | 6/1976 | Emmerson | 416/90 R |
| 4,004,056 | 1/1977 | Carroll | 428/138 |
| 4,064,300 | 12/1977 | Bhangu | 428/138 |
| 4,168,348 | 9/1979 | Bhangu et al. | 428/573 |

FOREIGN PATENT DOCUMENTS 2555814 6/1976 Fed. Rep. of Germany .

*Primary Examiner*—William J. Van Balen

*Attorney, Agent, or Firm*—Cushman, Darby & Cushman

[57] ABSTRACT

A perforate laminated material suitable for use in the manufacture of combustion chambers for gas turbine engines comprises two sheets bonded together, each sheet having a plurality of perforations, the laminated material being formed with internal channels which interconnect the perforations in the abutting sheets, the contact area between the two sheets being in the range 18% to 60% of the surface area of one side of one of the sheets and the ratio between the number of perforations per unit area in the sheets being in the range 2:1 to 10:1 in use the sheet having the larger number of perforations being adjacent a relatively hot gas stream.

4 Claims, 20 Drawing Figures

□ COLD SIDE

○ HOT SIDE

□ COLD SIDE

○ HOT SIDE

PERFORATE LAMINATED MATERIAL AND COMBUSTION CHAMBERS MADE THEREFROM

Figure 1:
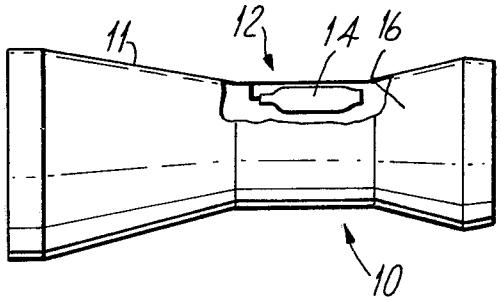

This invention relates to perforate laminated material which is particularly suitable for use in the high temperature sections of gas turbine engines, e.g. combustion chambers.

It is desirable that the turbine entry temperatures of gas turbine engines are as high as possible because of the need to produce engines having a higher thrust and/or improved operating efficiencies. The thermal efficiency, i.e. the power output and fuel consumption can be improved by higher compressor pressures and higher combustion temperatures. The higher compressor pressure will in turn give rise to higher compressor delivery temperatures and higher pressures and temperatures in the combustion chamber. These temperature increases make it more difficult to maintain the combustion chamber wall at an acceptable temperature which is determined by the mechanical and thermal properties of the wall material. The present invention seeks to provide a perforate laminated material which is suitable as a material for a combustion chamber wall and a combustion chamber made therefrom.

According to the present invention there is provided a perforate laminated material comprising at least two abutting sheets bonded together in face-to-face relationship, each sheet being provided with a plurality of perforations, the abutting surface of at least one of said sheets being provided with a plurality of channels adapted to interconnect the perforations of the abutting sheet, the contact area between said two sheets being in the range 18% to 60% of the surface area of one side of one of said sheets and the ratio between the number of perforations per unit area in said sheets being in the range 2:1 to 10:1 in use, the sheet having the larger number of perforations being adjacent a relatively hot gas stream and the sheet having the smaller number of perforations being adjacent a relatively cool gas stream.

According to a further aspect of the present invention there is provided a gas turbine engine combustion chamber formed at least in part from a perforate laminated material comprising two abutting sheets bonded together in face-to-face relationship, each sheet being provided with a plurality of perforations, the abutting surface of at least one of said sheets being provided with a plurality of channels adapted to interconnect the perforations of the abutting sheet, the contact area between said two sheets being in the range 18% to 60% of the surface area of one side of one of said sheets and the ratio between the number of perforations per unit area in said sheets being in the range 2:1 to 10:1 in use, the sheet having the larger number of perforations being adjacent a relatively hot gas stream and the sheet having the smaller number of perforations being adjacent a relatively cool gas stream.

Preferably the pattern of those perforations adjacent in use the relatively hot gas stream is arranged such that adjacent perforations in the upstream and downstream direction are not axially aligned, e.g. the pattern of perforations may be inclined at an angle in the range 10° to 33°, e.g. 30° to the horizontal axis of the combustion chamber, which angle has been found to be appropriate.

The perforations in use including those adjacent the relatively hot gas stream can be evenly spaced so that they are uniformly spaced out over the surface of the combustion chamber or the density can be varied, e.g. it can be increased in the region of a joint between adjacent parts of the combustion chamber or any other part where increased cooling effect is required or the density can diminish in the downstream direction, so that the maximum cooling effect is provided at the upstream end of the combustion chamber and a reduced cooling effect is provided at the downstream end of the combustion chamber, so as to either cause the combustion-chamber wall to be of substantially constant temperature or to have a substantially uniform temperature gradient.

Figure 2:
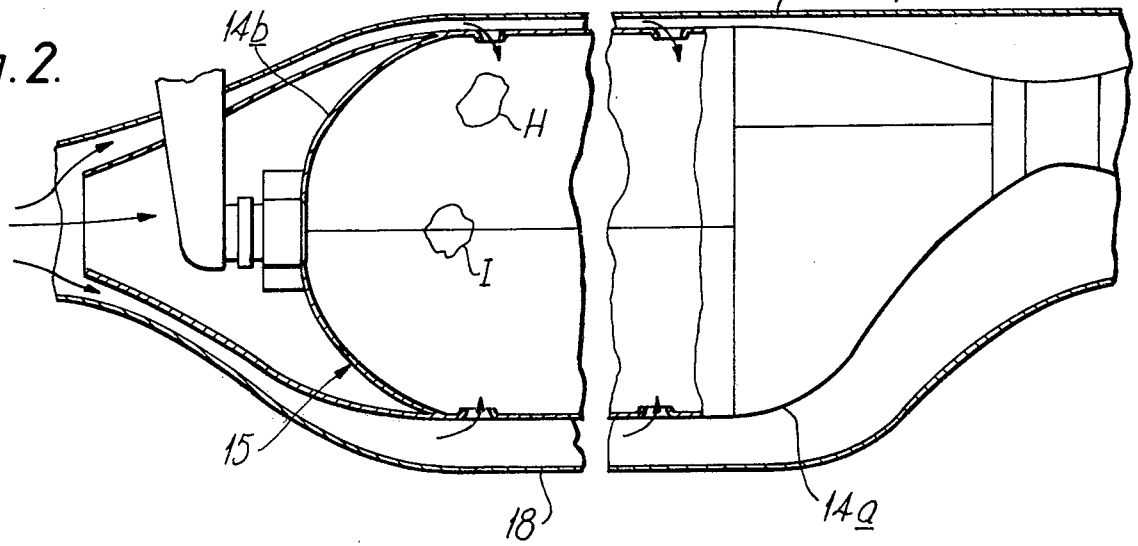
Figure 3:
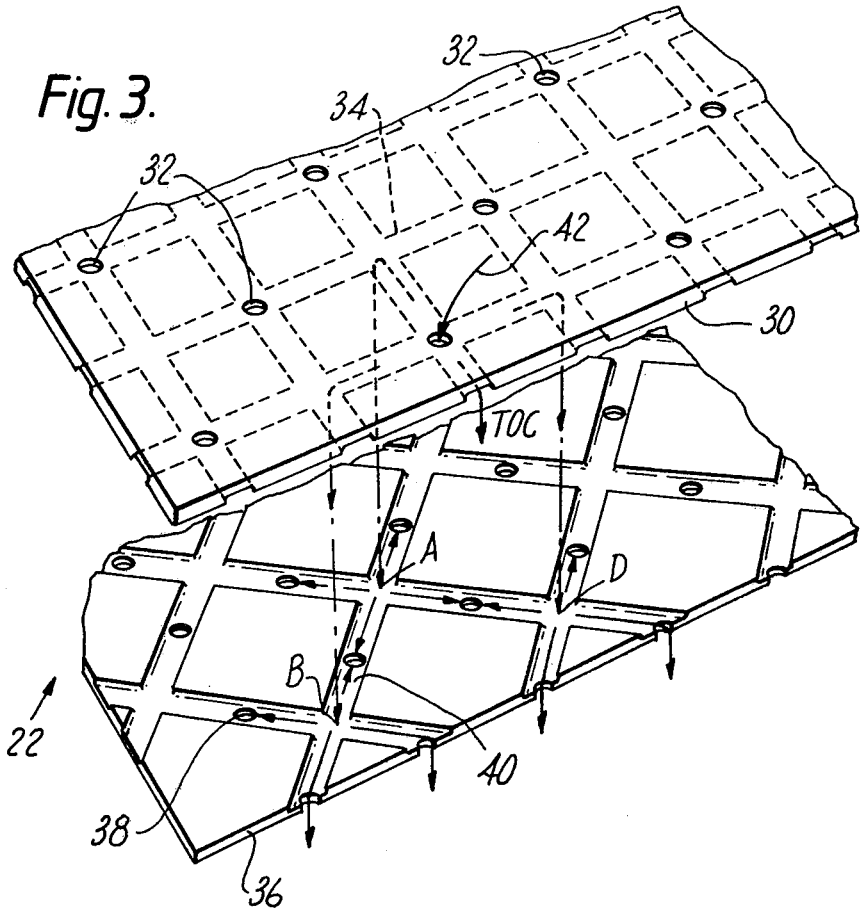
Figure 8:
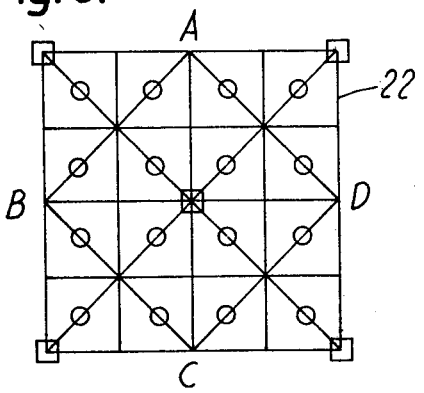
Figure 9:
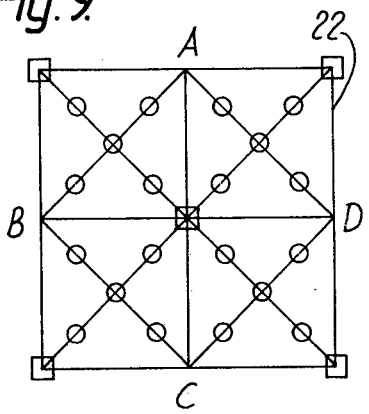
Figure 10:
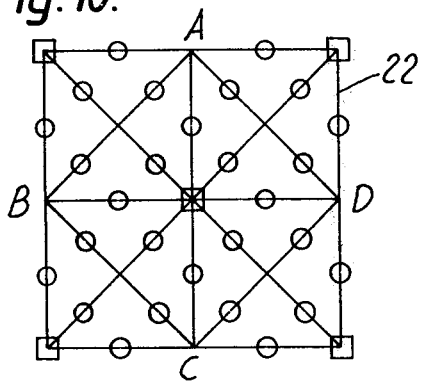
Figure 12:
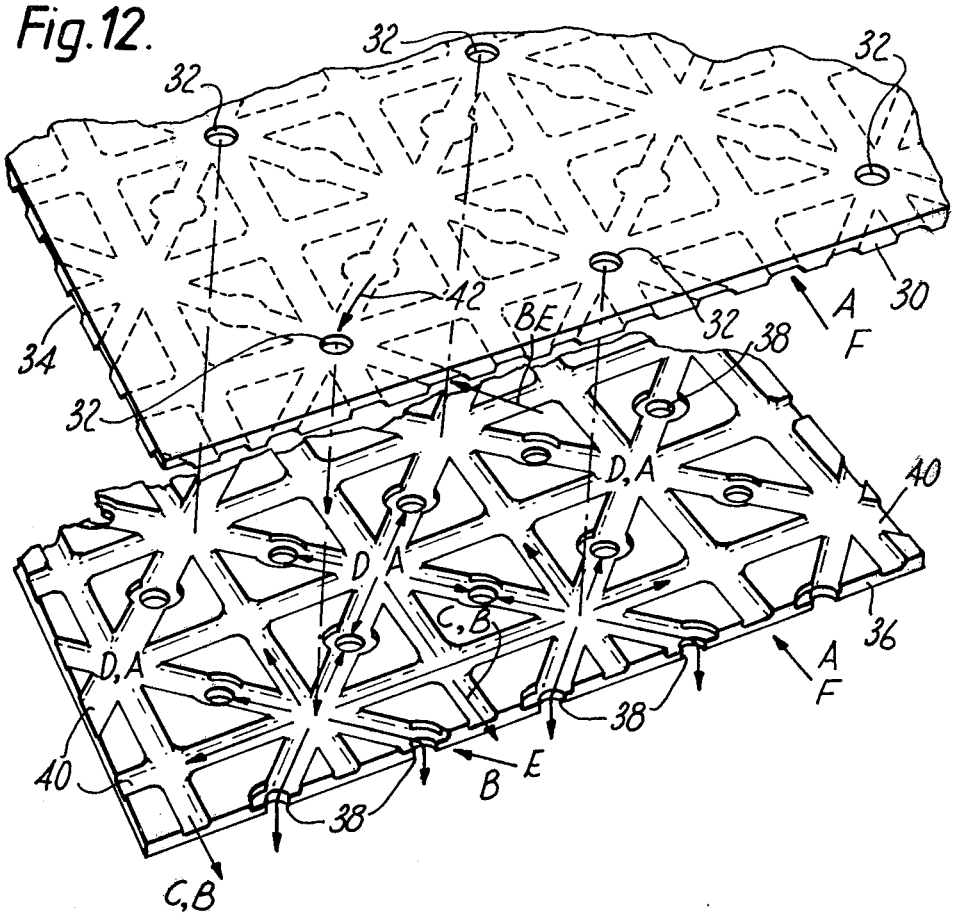
Figure 13:
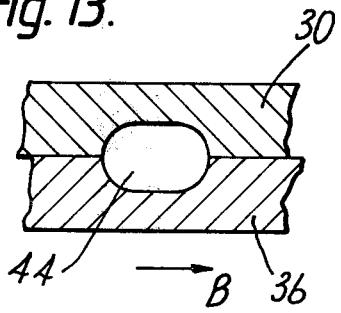
Figure 14:
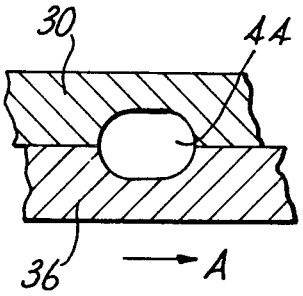
Figure 15:
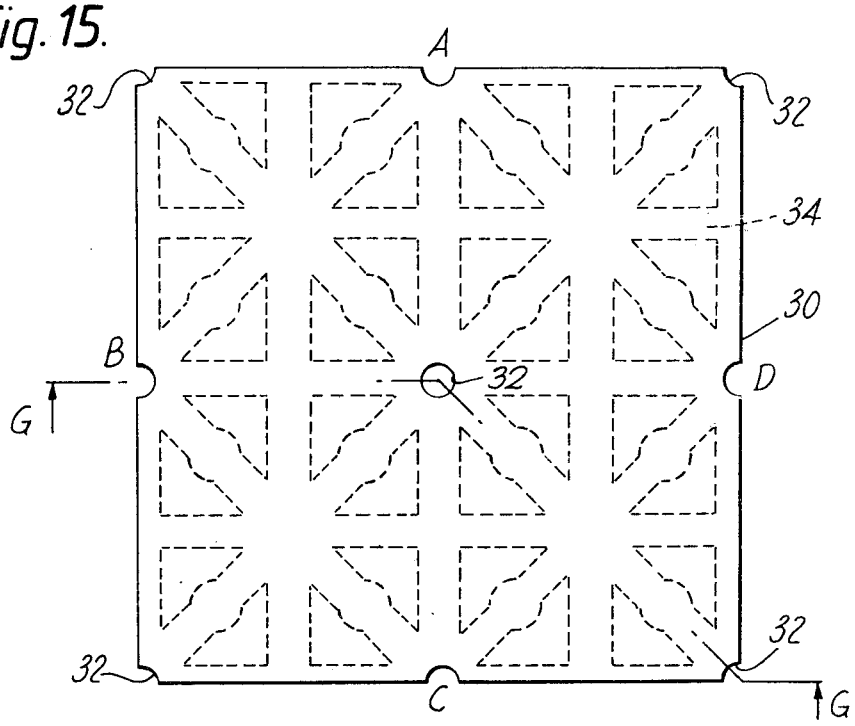
Figure 16:
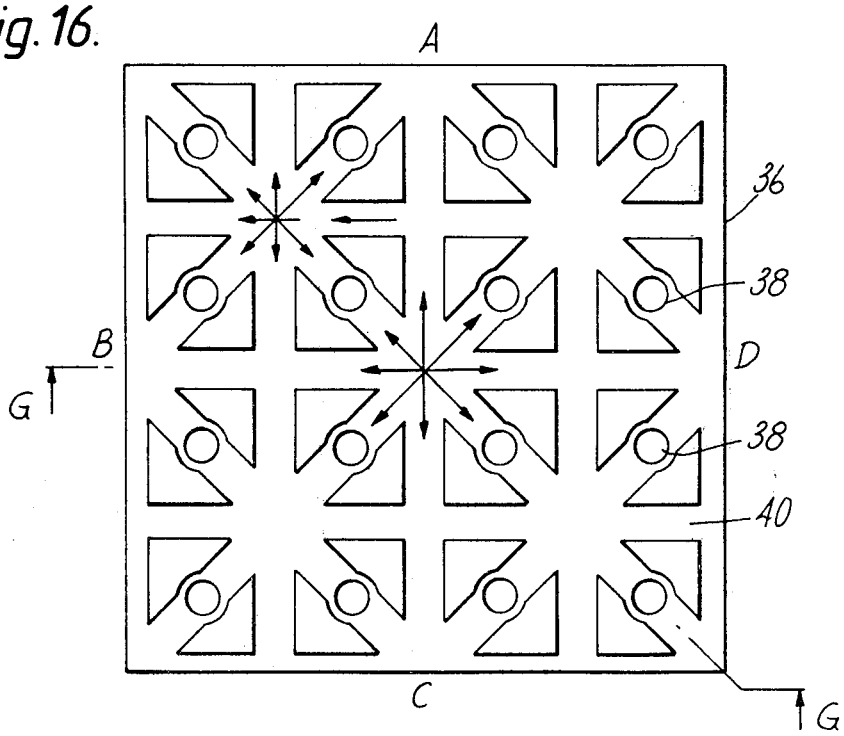
Figure 17:
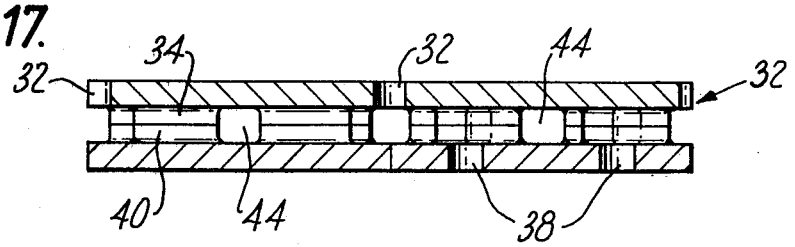
Figure 18:
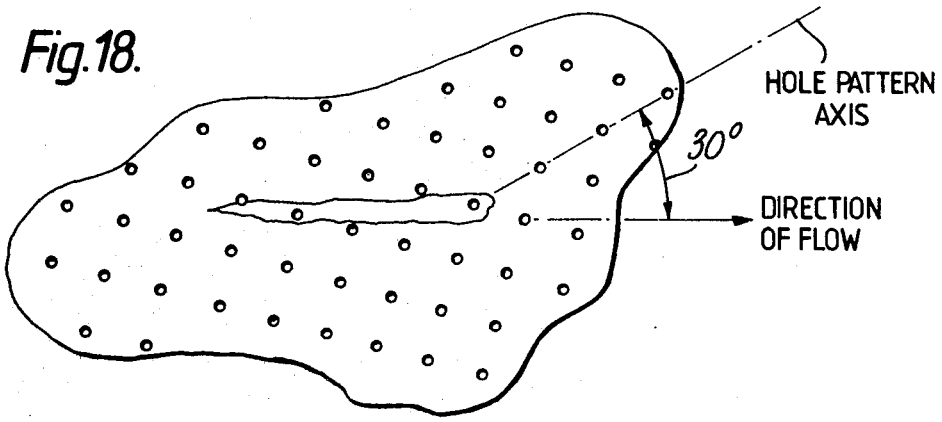
Figure 19:
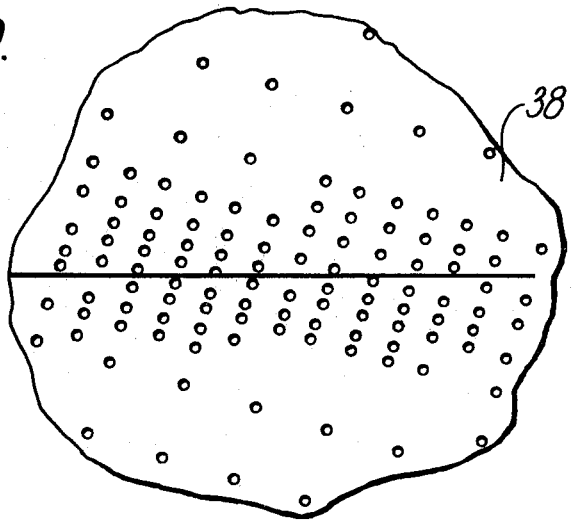
Figure 20:
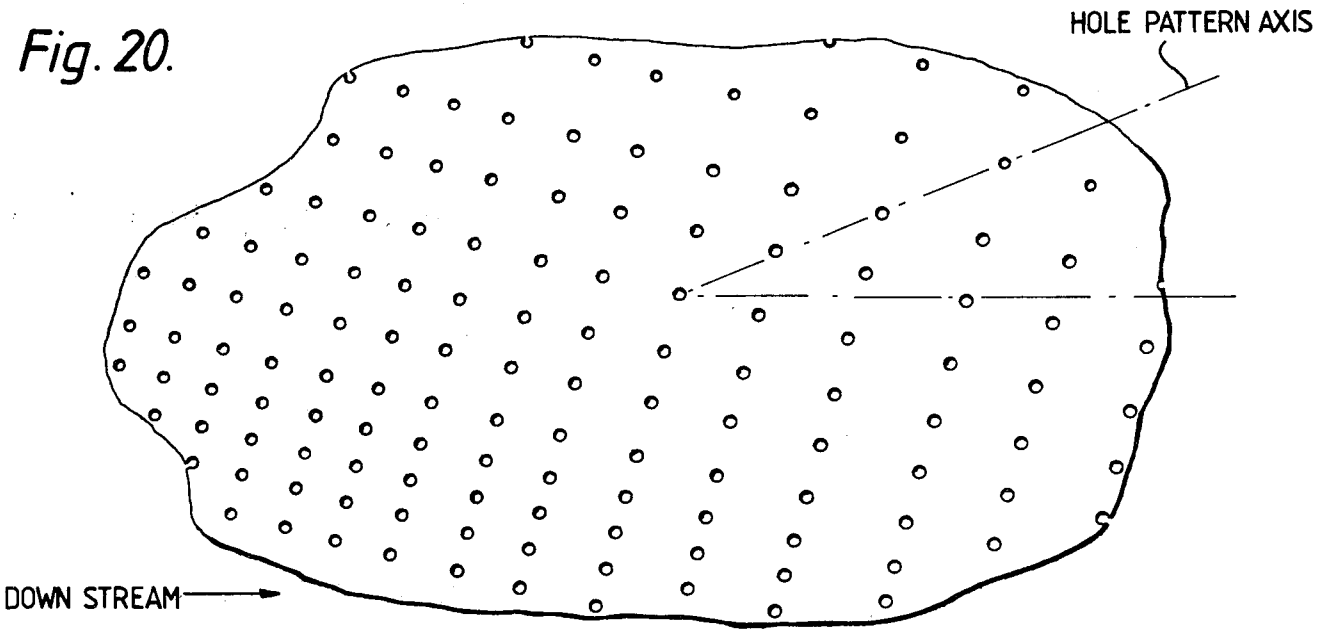

The present invention will now be more particularly described by way of example only, with reference to the accompanying drawings in which;

FIG. 1 shows in diagrammatic form, a gas turbine engine having a combustion chamber according to the present invention, FIG. 2 shows the combustion chamber of FIG. 1 to a larger scale, FIG. 3 shows a form of perforate laminated material shown in our U.K. Pat. No. 1530594 from which the combustion chamber in FIGS. 1 and 2 can be made, FIGS. 4 to 11 show diagrammatically various arrangements of the perforated laminated material in which the ratio of the number of holes in the two sheets of the laminate varies from 1:2 to 1:14, FIG. 12 is an exploded perspective view of the perforated laminated material shown in FIG. 5, FIG. 13 is a view on arrow E, in FIG. 12, FIG. 14 is a view on arrow F in FIG. 12, FIG. 15 is a plan view of the top sheet of the perforated laminated material shown in FIG. 8, FIG. 16 is a plan view of the bottom sheet of the perforated laminated material shown in FIG. 8, FIG. 17 is a section on line G—G in FIGS. 15 and 16, FIG. 18 is a detail to an enlarged scale of a part of the interior surface of the combustion chamber in FIGS. 1 and 2, designated H, FIG. 19 is a detail to an enlarged scale of a part of the interior surface of the combustion chamber shown in FIGS. 1 and 2, designated I and, FIG. 20 is an alternative arrangement of perforations to that shown in FIG. 18.

Referring to the Figures, particularly FIGS. 1 and 2 gas turbine engine 10 comprises in flow series a compressor 11, combustion equipment 12 including an annular or tubo-annular combustion chamber 14 and a compressor driving turbine 16.

The can 15 of the combustion chamber 14 is circular in cross-section and is contained within an annulus formed by inner and outer walls 18 and 20 respectively, the wall and head 14*a* and 14*b* respectively, being formed from perforate laminated material 22. Cooling air and dilution air is directed through the space between the walls 18 and 20 and the can 15 and the cooling air passes through the perforate laminated material to form a cooling film on the inner surface thereof. Cooling air is also passed to the head 14*b*.

FIG. 3 shows the material 22 in detail in exploded form. The material comprises an outer sheet 30 provided with a series of symetrically arranged holes 32 and a series of symetrically arranged channels 34. The channels 34 are formed in one surface only, the holes 32 and the channels 34 having been produced by electrochemical etching with the holes 32 being positioned at alternate intersections along the channels 34 with the holes in one channel being interdigitated with the holes in the adjacent channels. An inner sheet 36 is also provided with a series of symetrically arranged holes 38 and interconnecting channels 40, the channels again being formed in one surface only but there are twice as many holes per unit area in sheet 36 as in sheet 30. The holes 38 are positioned in the sheet 36 to pass through the sheet mid-way between the intersections of the channels 40. The sheets are brazed together in face-to-face relationship on the contacting areas between the channels 34 and 40 with the channels and holes out of alignment.

It will be seen that the channels are arranged in a square pattern on each sheet, but the width of the squares is slightly greater on sheet 36 and the sheets are brazed together with the channels disposed diagonally relative to each other and with their intersections in the channels 34 which do not possess holes 32, being positioned opposite the intersections in the channels 46. It will be seen that a fluid, such as air entering a hole 32 as shown by the arrows 42 splits into four parts and flows radially away from the hole along channels 34. The air flows into the channels 40 at the overlying intersections of the channels 34 and 40 and is again split into four radial parts before passing through the sheet 36 via the holes 38. The major cooling effect is by impingement though there is some cooling by convection as the cooling air follows the tortuous flow path, the degree of cooling being dependent upon the dimensions of the holes and channels, their spacings and numbers.

In use, the sheet 36 with the larger number of holes 38 is exposed to higher temperatures, e.g. in a combustion chamber, and cooling air is supplied to the holes 32 in the sheet 30, the holes 32 being referred to as cold-side holes and the holes 38 being referred to as hot-side holes. The larger number of holes in sheet 36 permits a more even distribution of cooling air over the outer surface of sheet 36 to provide effectively a film of cooling air.

The sheets can be made of any suitable high temperature material such as nickel alloys available under the trade names INCONEL 586, also known as NIMONIC 86.

Figure 4:
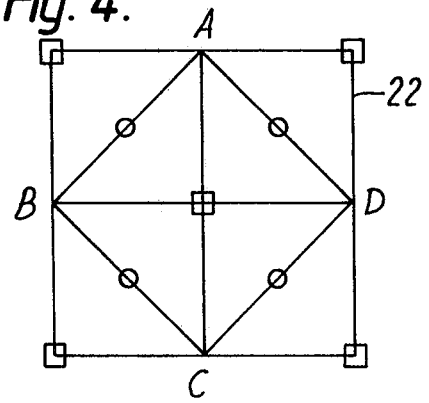
Figure 5:
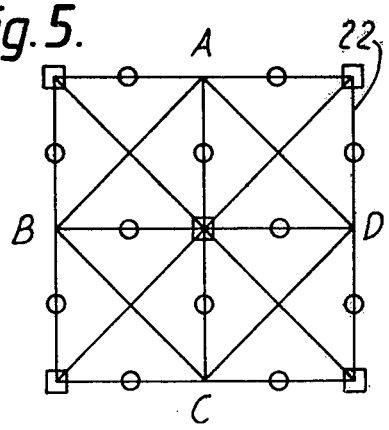
Figure 6:
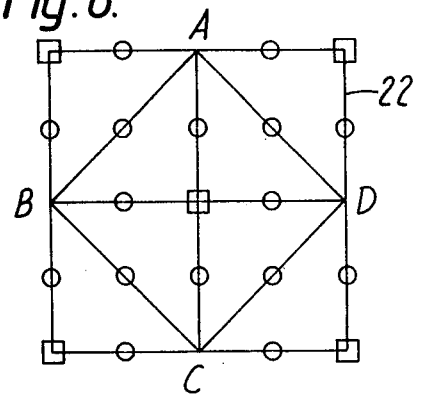
Figure 7:
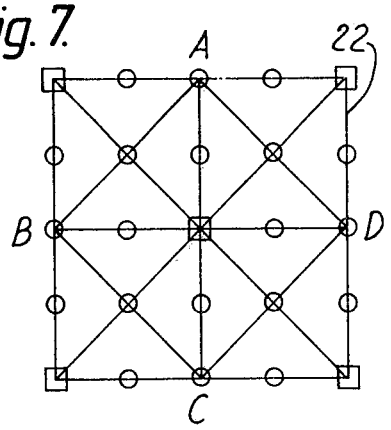
Figure 11:
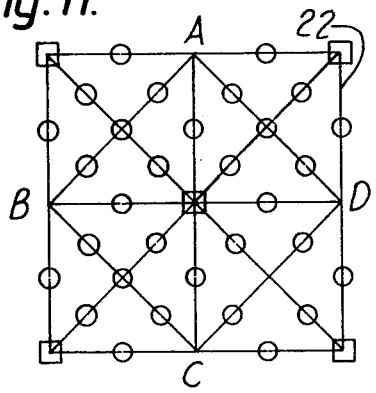

FIGS. 4 and 11 inclusive show diagrammatically various arrangements of perforated laminated material in which the ratios between the numbers of hot-side holes to cold-side holes vary between 2:1 (FIG. 2) and 14:1 (FIG. 11) the other ratios being 4:1 (FIG. 5), 6:1 (FIG. 6), 7:1 (FIG. 7), 8:1 (FIG. 8), 10:1 (FIG. 9), 12:1 (FIG. 10) and 14:1 (FIG. 11). The cold-side holes are indicated by a rectangular sign and the hot-side holes by a circular sign, the ratio being determined by counting the number of cold-side holes and hot-side holes contained within the rectangle denoted. A B C D on each of FIGS. 4 to 11. In each arrangement, there is only one cold-side hole which is in the centre of the rectangle and for example in FIG. 8, which shows a hole ratio of 8:1, there are four complete hot-side holes and eight half complete holes, making a total of eight hot-side holes to one cold-side hole. The lines in these diagrams represent the channels 34, 40 in the sheets 30 and 36 respectively, which in some cases e.g. FIGS. 4 to 11 correspond and in other cases are out of register, e.g. FIG. 3.

In some of the arrangements shown in FIGS. 4 to 11 it has been found to be useful to block some of the channels adjacent the cold-side entry holes to force the cooling air to take a longer flow path and feed more hot-side holes, otherwise those hot-side holes closest to the cold-side entry hole would tend to take most of the cooling flow thereby starring those hot-side holes furthest from the cold-side hole.

FIGS. 12, 13 and 14 show in greater detail the arrangement of perforated laminated material shown in FIG. 5, in which the hole ratio is 4:1.

Each sheet 30, 36 is formed with the same pattern of channels 34, 40 so that when the sheets are brazed together the channel pattern is in register and passages 44 (FIG. 17) for the throughflow of cooling air are created by corresponding channels in the two sheets. A suitable brazing alloy is one made in accordance with B.S. 1845-(N13) and commercially available alloys which meet this specification are CM 53 from Endurance Alloy and NICROBRAZE LM. The preferable brazing temperature is 1100° C. The passages 44 are shown more clearly in FIGS. 13 and 14 in which FIG. 13 is a view along one of the diagonal passages and FIG. 4 is a view along one of the lateral passages.

The flow of cooling air is indicated by the arrow 42, and the cooling air, first flows through each cold-side hole 32 and divides into eight parts, four of which flow directly along passages 44, and out of hot-side holes 38, whilst the remaining four parts flow to the same hot-side holes via lateral passages 44 after coalescing and dividing again from corresponding cooling air flows from other cold-side holes 32.

FIGS. 15, 16 and 17 show in greater detail the arrangement of perforated laminated material shown in FIG. 8 in which the hole ratio is 8:1. In this version, the cooling air through one of the cold-side holes 32 is divided up so that a proportion of it flows directly to four hot-side holes 38, whilst the remaining proportion is indirectly supplied to provide half the flow for each of the eight hot-side holes in the rectangle A B C D, the other half of the supply to these eight holes coming from the cooling air flow through other cold-side holes 32.

It has been found in practice that the ratio between the numbers of hot-side holes and cold-side holes should be at least 2:1 to provide adequate cooling and this ratio can be increased as required, e.g. to 14:1 though for practical purposes this ratio should be in the range 2:1 to 10:1.

It has been found that the contact area between the two sheets is important and this area expressed as a proportion of sheet area should be in the range 18%-60% and preferably in the range 30% to 60%, other features of the perforated laminated material according to the invention are as follows:

the cold-side and hot-side holes should be in the range 0.020" to 0.040" diameter, the passage sizes should be of width in the range 0.020" to 0.050" and depth in the range 0.020" to 0.030" to minimise the risk of blockage by airborne particles, oil, fuel cracking and oxidation, the overall thickness should be in the range 0.030" to 0.100"

the metal thickness over the channels should be sufficient for strength purposes taking into account any reduction in thickness due to oxidation in use when made up into a combustion chamber (FIGS. 2 and 18) the hot-side hole pattern should be included at a suitable angle in the range 10° to 30°, e.g. 30° to the longitudinal axis of the combustion chamber so that any hot-streaks passing through the chamber can be fed with cooling air, since if the hot-side holes were axially aligned, a hot streak could go through the chamber between adjacent rows of hot-side holes and not be film cooled at all, as shown in FIG. 19, which shows a part of the combustion chamber 14 in the area of a joint between the components, each formed from perforated laminated material according to the invention, the density of the hot-side holes can be increased to provide adequate cooling in the region of the joint, as it is inevitable that when the material is cut and welded together, some of the cooling holes will be blocked off, because of the weld width and the inclination of the hole pattern.

Referring to FIG. 20, the density of the hole pattern can be arranged to decrease in a downstream direction, so that the cooling air flow is at a maximum in the upstream part of the combustion chamber and decreases to a minimum at the downstream part. Thus the hole pattern can be tailored to provide a combustion chamber in which the wall temperature is substantially constant over its length or the wall temperature can be arranged to vary at a pre-determined rate.

Also the channels 44 which are created by adjacent channels 34, 40 in the two sheets can be formed by producing a suitably sized channel in one sheet only, the other sheet not having any channels.

We claim:

1. In a gas turbine engine combustion chamber of the type including a wall, at least part of the said wall being formed from a perforate laminated material, said material comprising first and second sheets having abutting surfaces, each of said sheets being provided with a plurality of perforations, at least one of the abutting surfaces of said sheets being provided with channels defining passageways in said perforate laminated material interconnecting said perforations of said first sheet with said perforations in said second sheet, said perforations in said first sheet being operable to meter the flow of a cooling fluid successively through said first and said second sheets, whereby discrete flows of said cooling fluid pass through said perforations in said first sheet and impinge upon the inside surface of said second sheet and then are emitted from the perforations of said second sheet, said perforations in said second sheet having a total cross-sectional area at least double the total cross-sectional area of perforations in said first sheet in a predetermined area of said material whereby cooling fluid emitted from the perforations of said second sheet tends to coalesce and substantially produce a film of cooling fluid adjacent to the outer surface of said second sheet over said predetermined area, said first sheet being defined as an outer cold-side sheet and said second of said sheets being defined as an inner hot-side sheet of said perforated laminated material of said combustion chamber, the improvement comprising the perforations of said inner hot-side sheet including a pattern in which adjacent perforations in said predetermined area of said perforate laminated material are out of alignment with each other axially along an axis parallel to the longitudinal axis of the combustion chamber and circumferentially out of alignment with each other in a plane transverse to the longitudinal axis of the combustion chamber whereby hot streaks of combustion products are prevented from developing along the outer surface of the inner hot-side sheet.

2. A combustion chamber as claimed in claim 1 in which said patterns of perforations in the inner hot-side sheet extend in a line inclined at an angle to the longitudinal axis of said combustion chamber.

3. A combustion chamber as claimed in claim 2 in which said pattern of perforations comprises a plurality of rectangles, imaginary diagonal lines joining opposite perforations in each rectangle all being inclined to the longitudinal axis of the combustion chamber at an angle of inclination in the range of 10° to 30°.

4. A combustion chamber as claimed in claim 1 in which a plurality of wall elements are welded together to form a major part of the wall of the combustion chamber, said perforations in both sheets having a density greater in the region of the joints between wall elements than in locally adjacent parts of the respective wall elements.

* * * * *